US006591755B2

(12) United States Patent
Theurer et al.

(10) Patent No.: US 6,591,755 B2
(45) Date of Patent: Jul. 15, 2003

(54) METHOD OF RENEWING TIES OF A RAILROAD TRACK, AND INSTALLATION FOR REMOVING AND STORING DAMAGED TIES

(75) Inventors: Josef Theurer, Vienna (AT); Herbert Wörgötter, Gallneukirchen (AT)

(73) Assignee: Franz Plasser Bahnbamaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/059,797

(22) Filed: Jan. 29, 2002

(65) Prior Publication Data

US 2002/0121216 A1 Sep. 5, 2002

(30) Foreign Application Priority Data

Mar. 2, 2001 (AT) ..... 154/2001 U

(51) Int. Cl.[7] ..... E01B 29/00
(52) U.S. Cl. ..... 104/2; 104/9
(58) Field of Search ..... 104/2, 6, 7.3, 9; 241/101.74, 101.741, 101.742, 101.75

(56) References Cited

U.S. PATENT DOCUMENTS 3,161,213 A 12/1964 Bryan, Jr.
3,701,483 A 10/1972 Crosby et al.
3,752,409 A * 8/1973 Lewis ..... 241/60
4,127,070 A 11/1978 Dieringer et al.
4,961,539 A * 10/1990 Deem ..... 241/101.741
5,193,461 A 3/1993 Theurer et al.
5,364,221 A * 11/1994 Theurer et al. ..... 104/2
5,400,718 A * 3/1995 Theurer et al. ..... 104/2
5,993,131 A * 11/1999 Theurer et al. ..... 104/2
6,089,162 A * 7/2000 Madison ..... 104/2

FOREIGN PATENT DOCUMENTS

AT 400 341 B 12/1995

* cited by examiner

*Primary Examiner*—Mark T. Le
(74) *Attorney, Agent, or Firm*—Henry M. Feierisen

(57) ABSTRACT

In a method of renewing ties of a railroad track extending in a longitudinal direction and including a succession of ties supported on a ballast bed, damaged old ties are comminuted either before removal from the track or after removal of the track and subsequently ejected into a storage wagon by a first conveyor device extending longitudinally in the direction of the track. The comminuted ties are then transported via a second conveyor device, extending in the longitudinal direction, to a number of further like storage wagons arranged behind one another, for selectively filling the further storage wagons, whereas new tie replace the removed damaged ties.

12 Claims, 1 Drawing Sheet

METHOD OF RENEWING TIES OF A RAILROAD TRACK, AND INSTALLATION FOR REMOVING AND STORING DAMAGED TIES

CROSS-REFERENCES TO RELATED APPLICATIONS

This application claims the priority of Austrian utility model GM 154/2001, filed Mar. 2, 2001, the subject matter of which is incorporated herein by reference.

BACKGROUND OF THE INVENTION

The present invention relates, in general, to a method of renewing ties of a railroad track extending in a longitudinal direction and including a succession of ties supported on a ballast bed, and more particularly but not exclusively to a method which involves a removal of a damaged tie from the track and replacement of the damaged tie by a new tie. The present invention also relates to an installation for lifting damaged ties from a railroad track and storing the ties.

A work train for renewing ties of a track is disclosed in U.S. Pat. No. 6,089,162, and has several vehicles including storage wagons. Old ties are lifted by a crane vehicle, which travels along the train, and stored in a storage wagon. When old ties break into pieces during their removal and thus are difficult to handle in transport, these pieces are discharged into a separate storage container.

U.S. Pat. No. 3,161,213 describes an installation for cutting old ties in the ballast bed of the track, by using a saw to thereby facilitate a removal and transport of old ties.

U.S. Pat. No. 3,701,483 describes a track-bound installation having a conveyor belt for picking up old ties laying on the track and transporting them to a device having rotating blades for comminuting or shredding the ties. A further conveyor belt, which extends perpendicularly to the longitudinal direction of the track, discharges the comminuted wood parts laterally onto a region adjacent to the track.

It would be desirable and advantageous to provide an improved method and installation for more efficient removal of old or damaged ties from a railroad track.

SUMMARY OF THE INVENTION

According to one aspect of the present invention, a method of removing a damaged tie includes the steps of comminuting a damaged tie into pieces either before removal of the damaged tie or after removal of the damaged tie, ejecting the pieces into a storage wagon by a first conveyor device, transporting the pieces from the storage wagon by a second conveyor device to a number of further like storage wagons arranged behind one another, for selectively filling the further storage wagons, and replacing the damaged tie in the track by a new tie.

When carrying out the comminution of a damaged tie after removal of the damaged tie from the track, the comminution is implemented in a comminution device by which the damaged tie is comminuted into shredded pieces. On the other hand, when comminuting a damaged tie, while still laying in the track, the comminution is implemented by a saw for cutting the damaged tie into cut pieces. In the following description, the term "shredded pieces" will refer to a comminution by which the damaged tie is comminuted into many very small fragments of undefined contour in the comminution device, whereas the term "cut pieces" will refer to a comminution by which the damaged tie is comminuted into few parts of distinct contour by the saw.

The present invention resolves prior art problems as a consequence of disturbances caused by brittle or broken old ties and thus impaired transport efficiency, by basing the entire tie replacement method and tie transport system upon a general comminution of the damaged old ties into shredded pieces or cut pieces which are then transported away in the comminuted state. Since the complete transport and storage system is now based exclusively on comminuted ties, the efficiency of the tie renewal process is significantly enhanced, as a time-consuming gripping, lining-up and transporting of the old ties to the storage sites in their bulky whole form is no longer necessary. Rather, by using the novel and inventive method according to the invention, the comminuted ties, whether shredded or cut, can simply be transported onwards very easily and automatically in great bulk via conveyor belts for filling large-capacity storage wagons.

According to another aspect of the present invention, an on-track installation for lifting damaged ties from a railroad track and storing the damaged ties, includes a lifting device for gripping and lifting a damaged tie from the ballast bed, a depositing station for intermediate storage of the damaged tie, a comminuting device configured for receiving the intermediately stored damaged tie and for comminuting the damaged tie into pieces, a conveyor device receiving the pieces from the comminuting device, said conveyor device extending longitudinally in a direction of the track and including a discharging end for ejecting the pieces, and at least one storage wagon having one end distal to the conveyor device and including a bottom conveyor belt, which extends in the longitudinal direction, and a transfer conveyor belt, which extends the bottom conveyor belt beyond the distal end of the storage wagon and has a discharging end positioned higher than the bottom conveyor belt.

With an installation according to the present invention, efficient removal of the damaged old ties can be realized in a time-saving and automatic manner while ensuring a reliable operation, as there are no bulky, unwieldy or broken tie parts that could interfere with the transport thereof.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
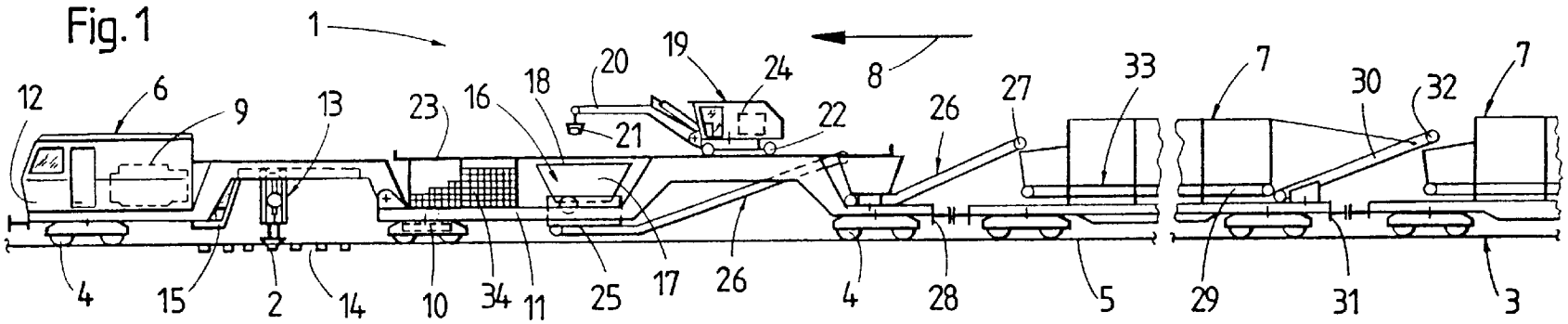
FIG. 1 is a simplified side elevational view of an installation according to the present invention for lifting damaged ties.

Throughout all the Figures, same or corresponding elements are generally indicated by same reference numerals.

Turning now to the drawing, and in particular to FIG. 1, there is shown a side elevational view of an installation according to the present invention, generally designated by reference numeral 1 and mounted for mobility on a railroad track 3 extending in a longitudinal direction. The track 3 includes rails 5 which are connected to a succession of ties 2 supported on a ballast bed 14. The installation 1 is designed for lifting damaged ties 2 from the track 3 and for storing them and includes a working vehicle 6, supported by track-bound undercarriages 4, and a number of like storage wagons 7 coupled thereto. Of course, the number of storage wagons is arbitrary and depends on the expected storage demand. The working vehicle 6 together with the storage wagons travel together on the track 3 in an operating direction indicated by arrow 8. A power source 9 is provided on the working vehicle 6 to supply energy to a motive drive 10 and to further drives, yet to be described, of the installation 1.

The working vehicle 6 includes a machine frame 11 which, because of its great length, is composed of two hingedly coupled frame parts. A driver's cab 12 is arranged at one end of the vehicle 6 and followed in the operating direction by an operator's cab 15. Located within the range of sight of the operator's cab 15, in a portion of the machine frame 11 designed offset in a vertical direction, is a lifting device 13 for gripping and raising ties 2 from the ballast bed 14 of the track 3 which are damaged and need to be replaced. The lifting device 13 is mounted on the machine frame 11 for vertical and transverse adjustment as well as for displacement in the longitudinal direction. A specific construction and manner in which such a lifting device is operatively and functionally incorporated into an installation of the present invention is fully described in U.S. Pat. No. 5,193,461, the entire specification and drawings of which are expressly incorporated herein by reference.

Further provided on the machine frame 11 is a comminuting device 16, which includes, for example, rotatable knives, and a container 17 with a charging opening 18 for receiving the damaged ties 2. A transporting vehicle 19 is mounted via flanged rollers 22 on guide rails 23, connected to the top of the machine frame 11, and is equipped with a vertically and transversely adjustable cantilever arm 20 with a tie grab 21 fastened to the end thereof. The transporting vehicle 19 is mobile along the installation 1 in the longitudinal direction with the aid of a motor 24 and shuttles between the lifting device 13 and the comminuting device 16 to transport and deliver damaged ties 2. Located underneath the comminuting device 16 is a receiving end 25 of a first conveyor device 26, which extends in the longitudinal direction. The conveyor device 26 has a discharging end 27 positioned at a rear end 28—with regard to the operating direction—of the working vehicle 6 and projecting over said end 28. The discharging end 27 is associated with the storage wagon 7 coupled immediately to the working vehicle 6.

Each storage wagon 7 includes a bottom conveyor belt 29, which extends in the longitudinal direction and terminates at a transfer conveyor belt 30. The transfer conveyor belt 30 projects beyond a wagon end 31, distanced from the first conveyor device 26, and has a discharging end 32 positioned higher than the bottom conveyor belt 29. Thus, when several storage wagons 7 are coupled to one another, a continuous, second conveyor device 33 is established which stretches across all of the wagons 7.

In working operation for renewing ties 2 of a track 3, the installation 1 is used to remove damaged old ties 2 from the track 3, which are subsequently replaced by new ties 34. The installation 1 travels hereby continuously along the track 3 in the operating direction (arrow 8) while individual damaged ties 2 are taken out of the ballast bed 14 by means of the lifting device 13 displaceable in the longitudinal direction. For the purpose of loading the ties 2, these are then seized by the tie grab 21 of the transporting vehicle 19 and transported in the longitudinal direction along the installation 1 to the charging opening 18 of the comminuting device 16 into which the ties 2 are dropped. Subsequently, the material, i.e. the shredded pieces, produced during comminution of the damaged ties 2, is advanced by the first conveyor device 26 in the longitudinal direction and discharged into the first storage wagon 7.

With the aid of the second conveyor device 33, extending in the longitudinal direction and stretching over the storage wagons 7 arranged one following the other, the comminuted ties 2 are then transported onward in a direction opposite to the operating direction for filling the respective adjoining storage wagons 7. By varying the transport speeds of the individual bottom conveyor belts 29 and transfer conveyor belts 30 extending in the longitudinal direction, the comminuted ties 2 can be either stored in a respective storage wagon 7 or transported through the same to the next following wagon 7, as needed.

As shown in FIG. 1, new ties 34 can be seen stacked on the machine frame 11 between the lifting device 13 and the comminuting device 16, for temporary storage before the start of working operations of the installation 1. This affords the possibility of employing the correspondingly designed installation 1 also for installing new ties 34. The new ties 34 can be gripped by means of the tie grab 21 of the transporting vehicle 19 and laid on the track 3 within reach of the lifting device 13. The new ties 34 are then seized by the device 13 and—upon reversal of the operating movements carried out previously—inserted laterally into the ballast bed 14 under the rails 5 of the track 3. Alternatively, new ties 34 can also be installed in the track 3 by means of a separate working unit (not shown) following behind the installation 1 in the operating direction.

Figure 2:
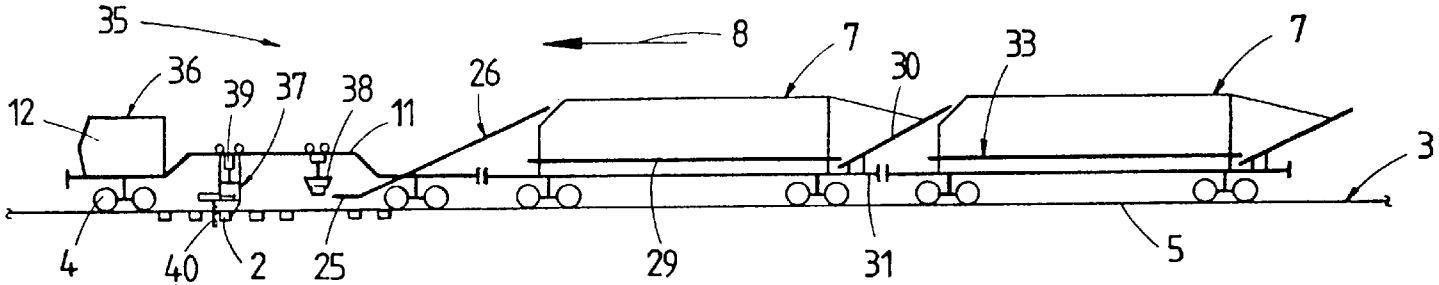
FIG. 2 is a simplified side elevational view of another embodiment of an installation according to the present invention for lifting damaged ties.

Turning now to FIG. 2, there is shown a side elevational view of another embodiment of an installation according to the present invention, generally designated by reference numeral 35 and including a working vehicle 36 and—similar to the installation 1—a number of like storage wagons 7 coupled thereto and following one another in the longitudinal direction. The storage wagons 7 are designed similar to the embodiment already described with reference to FIG. 1. The working vehicle 36 is equipped with a driver's cab 12 and has a machine frame 11 of recessed design on which are arranged a comminuting device 37 and a lifting device 38 which trails the comminuting device 37 in the operating direction (as indicated by arrow 8). In the embodiment of FIG. 2, the comminuting device 37 is designed as a tie saw 40, vertically adjustable with the aid of a drive 39, for sawing the damaged tie 2 into several, for example three, cut pieces while still lying in the ballast bed 14. An exemplified construction and manner in which such a saw is operatively and functionally incorporated into an installation of the present invention is fully described in U.S. Pat. No. 3,161,213.

The individual pieces of the tie 2, comminuted in this way, are subsequently gripped and placed on the receiving end 25 of a first conveyor device 26 by the lifting device 38 which, just like the comminuting device 37, is mounted on the machine frame 11 for mobility in the longitudinal direction of the installation 35. The conveyor device 26 extends in the longitudinal direction all the way to the forwardmost of the coupled storage wagons 7 and discharges the pieces of the comminuted tie 2 therein. The comminuted tie 2 is then transported onwards or, optionally, stored, as needed, with the aid of the bottom conveyor belts 29 and transfer conveyor belts 30, arranged in each of the storage wagons 7 and forming a second conveyor device 33.

Figure 3:
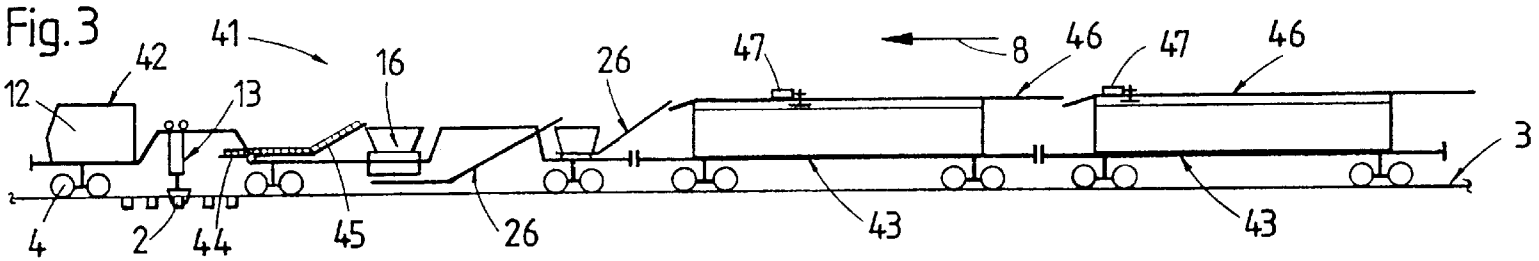
FIG. 3 is a simplified side elevational view of still another embodiment of an installation according to the present invention for lifting damaged ties.

FIG. 3 shows a side elevation of yet another embodiment of an installation according to the present invention, generally designated by reference numeral 41, for lifting damaged ties 2 from a track 3. The installation 41 includes a working vehicle 42 and a number of like storage wagons 43 coupled thereto. The working vehicle 42 differs from the vehicle 6, described above with reference to FIG. 1, in that no transporting vehicle and no guide rails associated therewith are provided in this case. Instead, the working vehicle 42 has a depositing station 44 arranged in the area of a lifting device 13 and serving for intermediate storage of the ties 2 lifted from the track 3. The ties 2 are deposited by the transversely, vertically and longitudinally adjustable lifting device 13 on the depositing station 44, which is connected to a tie conveyor 45 extending in the longitudinal direction. By means of the latter, the damaged ties 2 are then transported to a comminuting device 16 in which they are comminuted and subsequently discharged onto a first conveyor device 26 and transported onwards to the storage wagons 43.

The storage wagons 43 differ from the previously described storage wagons 7 by having, instead of bottom and transfer conveyor belts, a second conveyor device 46 which extends in its entirety above the storage wagons 43 in the longitudinal direction thereof. Additionally associated with each storage wagon 43 is a deflecting member 47 which is connected to the respective conveyor device 46 for adjustment in the longitudinal direction and with the aid of which the stream of comminuted tie material can be deflected, as needed, for the systematic filling of the storage wagon 43 located directly thereunder.

While the invention has been illustrated and described as embodied in a method of renewing ties of a railroad track, and installation for removing and storing damaged ties, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A method of renewing ties of a railroad track, comprising the steps of:

(a) providing a lifting device for gripping and lifting a damaged tie from the ballast bed and for gripping a new tie and laterally inserting the gripped new tie under the rails of the track;

(b) comminuting the damaged tie into pieces in one of the phases selected from the group consisting of before removal of the damaged tie and after removal of the damaged tie;

(c) ejecting the pieces into a storage wagon by a first conveyor device;

(d) transporting the pieces from the storage wagon by a second conveyor device to a number of further like storage wagons arranged behind one another, for selectively filling the further storage wagons; and (e) replacing the damaged tie in the track by the new tie.

2. The method of claim 1, wherein the pieces are transported above the storage wagons in the longitudinal direction thereof and optionally discharged into a one of the storage wagons situated thereunder.

3. The method of claim 1, wherein the damaged tie is comminuted into shreds.

4. The method of claim 1, wherein the damaged tie is comminuted by a saw into cut pieces.

5. A method of renewing ties of a railroad track, comprising the steps of:

(a) providing a lifting device for gripping and lifting a damaged tie from the ballast bed and for gripping a new tie and laterally inserting the gripped new tie under the rails of the track;

(b) removing the damaged tie from the track;

(c) comminuting the damaged tie into shredded pieces;

(d) ejecting the shredded pieces into a storage wagon by a first conveyor device;

(e) transporting the shredded pieces from the storage wagon by a second conveyor device to a number of further like storage wagons arranged behind one another, for selectively filling the further storage wagons; and (f) replacing the damaged tie in the track by the new tie.

6. A method of renewing ties of a railroad track, comprising the steps of:

(a) providing a lifting device for gripping and lifting a damaged tie from the ballast bed and for gripping a new tie and laterally inserting the gripped new tie under the rails of the track;

(b) comminuting the damaged tie, laying in the track, into cut pieces;

(c) removing the cut pieces from the track;

(d) ejecting the cut pieces into a storage wagon by a first conveyor device;

(e) transporting the cut pieces from the storage wagon by a second conveyor device to a number of further like storage wagons arranged behind one another, for selectively filling the further storage wagons; and (f) replacing the damaged tie in the track by the new tie.

7. The method of claim 6, wherein the damaged tie is comminuted into cut pieces by a saw.

8. A method of loading damaged ties from a railroad track, comprising the steps of (a) providing a lifting device for gripping and lifting a damaged tie from the ballast bed and for gripping a new tie and laterally inserting the gripped new tie under the rails of the track;

(b) comminuting the damaged tie into cut pieces;

(c) ejecting the cut pieces into a storage wagon by a conveyor device;

(d) transporting the pieces by a bottom conveyor belt, situated longitudinally in the storage wagon, to a transfer conveyor belt, which extends the bottom conveyor belt beyond an end of the storage wagon; and (e) ejecting the cut pieces into a further, adjoining storage wagon.

9. The method of claim 8, wherein the damaged tie is comminuted while laying in a ballast bed for the track.

10. A method of loading damaged ties lifted from a railroad track supported on a ballast bed, comprising the steps of:

(a) lifting a damaged tie from the ballast bed by providing a lifting device for gripping and lifting the damaged tie from the ballast bed and for gripping a new tie and laterally inserting the gripped new tie under the rails of the track;

(b) comminuting the damaged tie into shredded pieces in a comminuting device;

(c) ejecting the shredded pieces into a storage wagon by a conveyor device; and (d) transporting the shredded pieces by a bottom conveyor belt, situated longitudinally in the storage wagon, to a transfer conveyor belt, which extends the bottom conveyor belt beyond an end of the storage wagon, for optionally ejecting shredded pieces into a further, adjoining storage wagon.

11. An on-track installation for lifting damaged ties from a railroad track and storing the damaged ties, said installation comprising:

(a) a lifting device configured for gripping and lifting a damaged tie from the ballast bed and for gripping a new tie and laterally inserting the gripped new tie under the rails of the track;

(b) a depositing station for intermediate storage of the damaged tie;

(c) a comminuting device configured for receiving the intermediately stored damaged tie and for comminuting the damaged tie into pieces;

(d) a conveyor device receiving the pieces from the comminuting device, said conveyor device extending longitudinally in a direction of the track and including a discharging end for ejecting the pieces; and (e) at least one storage wagon having one end distal to the conveyor device and including a bottom conveyor belt, which extends in the longitudinal direction, and a transfer conveyor belt, which extends the bottom conveyor belt beyond the distal end of the storage wagon and has a discharging end positioned higher than the bottom conveyor belt.

12. The installation of claim 11, and further comprising a transporting vehicle mounted on the installation for mobility in the longitudinal direction and provided for the transport of new ties.

* * * * *